US011571887B2

(12) United States Patent
Silvestre Rivero et al.

(10) Patent No.: US 11,571,887 B2
(45) Date of Patent: Feb. 7, 2023

(54) THERMAL BASED DROP DETECTION

(71) Applicant: HEWLETT-PACKARD DEVELOPMENT COMPANY, L.P., Spring, TX (US)

(72) Inventors: Ricard Silvestre Rivero, Sant Cugat del Valles (ES); Jordi Hernandez Creus, Sant Cugat del Valles (ES); Mauricio Seras Franzoso, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 99 days.

(21) Appl. No.: 17/049,090

(22) PCT Filed: Aug. 30, 2018

(86) PCT No.: PCT/US2018/048696
§ 371 (c)(1),
(2) Date: Oct. 20, 2020

(87) PCT Pub. No.: WO2020/046303
PCT Pub. Date: Mar. 5, 2020

(65) Prior Publication Data

US 2021/0237436 A1 Aug. 5, 2021

(51) Int. Cl.
*B41J 2/045* (2006.01)
*B41J 2/21* (2006.01)
(Continued)

(52) U.S. Cl.
CPC ..... *B41J 2/04558* (2013.01); *B41J 2/0458* (2013.01); *B41J 2/125* (2013.01);
(Continued)

(58) Field of Classification Search
CPC .... B41J 2/04558; B41J 2/2142; B41J 2/0451; B41J 2/04563; B41J 2/165; B41J 2/16579; B41J 2/195
See application file for complete search history.

(56) References Cited

U.S. PATENT DOCUMENTS 5,644,343 A * 7/1997 Allen ..... B41J 2/195 347/17
6,024,430 A 2/2000 Koitabashi et al.
(Continued)

FOREIGN PATENT DOCUMENTS

CN 1051884 A 6/1991
CN 1467992 A 1/2004
(Continued)

OTHER PUBLICATIONS

Mike Willis; "Detecting drops by measuring temperature of actuator chamber"; Ink Jet Patents Blog; http://www.inkjetpatents.com/ijp-blog/; posted on Nov. 2015.

*Primary Examiner* — Scott A Richmond

(57) ABSTRACT

A system comprises a printhead including a nozzle, a temperature sensor and a processor. The temperature sensor detects the temperature of a location of a print surface upon firing the nozzle to eject a drop of printing fluid to the location of the print surface. The processor determines whether the nozzle ejected the drop properly using the detected temperature.

12 Claims, 5 Drawing Sheets

(51) Int. Cl.
*B41J 2/125* (2006.01)
*B41J 2/175* (2006.01)
*B41J 2/195* (2006.01)

(52) U.S. Cl.
CPC ..... *B41J 2/175* (2013.01); *B41J 2/195* (2013.01); *B41J 2/2142* (2013.01); *B41J 2/04581* (2013.01)

(56) References Cited

U.S. PATENT DOCUMENTS

| | | | | |
|---|---|---|---|---|
| 6,062,668 | A | 5/2000 | Cruz-Uribe | |
| 6,126,265 | A | 10/2000 | Winthrop et al. | |
| 6,299,275 | B1 | 10/2001 | Elgee | |
| 6,460,964 | B2 | 10/2002 | Osborne | |
| 6,634,731 | B2 | 10/2003 | Kao et al. | |
| 7,283,280 | B2 | 10/2007 | Lapstun et al. | |
| 9,268,023 | B2 | 2/2016 | Garay et al. | |
| 2009/0002428 | A1* | 1/2009 | Min | B41J 2/0458 347/19 |
| 2009/0058909 | A1 | 3/2009 | Vitaris et al. | |
| 2010/0225696 | A1 | 9/2010 | Shibata | |
| 2014/0020625 | A1* | 1/2014 | Masuo | B05C 9/12 118/688 |
| 2020/0406608 | A1* | 12/2020 | Anderson | B41J 2/0458 |

FOREIGN PATENT DOCUMENTS

| | | | |
|---|---|---|---|
| CN | 1880075 | A | 12/2006 |
| CN | 101152785 | A | 4/2008 |
| CN | 101362400 | A | 2/2009 |
| CN | 101746128 | A | 6/2010 |
| CN | 102602170 | A | 7/2012 |
| EP | 0562786 | A2 | 9/1993 |
| JP | 2015000510 | A | 1/2015 |

* cited by examiner

THERMAL BASED DROP DETECTION

BACKGROUND

Inkjet printers are fluid ejection devices that provide drop-on-demand ejection of fluid droplets through printhead nozzles to print images onto a print medium, such as a sheet of paper. Inkjet nozzles may become clogged and cease to operate correctly, and nozzles that do not properly eject printing fluid, such as ink, when expected may create visible print defects. Such print defects are commonly referred to as missing nozzle print defect. Missing nozzle print defects may result from printhead malfunction due to ink channel obstruction, low energy, bubbles or mechanical-electrical damages. Detecting nozzles not functioning properly and disabling such nozzles may reduce visible print defects. In addition, detecting nozzles not functioning properly and disabling such nozzles may avoid a raise of printhead temperatures and, therefore, permanent physical damage and burnout in the printhead.

BRIEF DESCRIPTION OF THE DRAWINGS

Examples will now be described, by way of non-limited examples, with reference to the accompanying drawings, in which.

DETAILED DESCRIPTION

Figure 1:
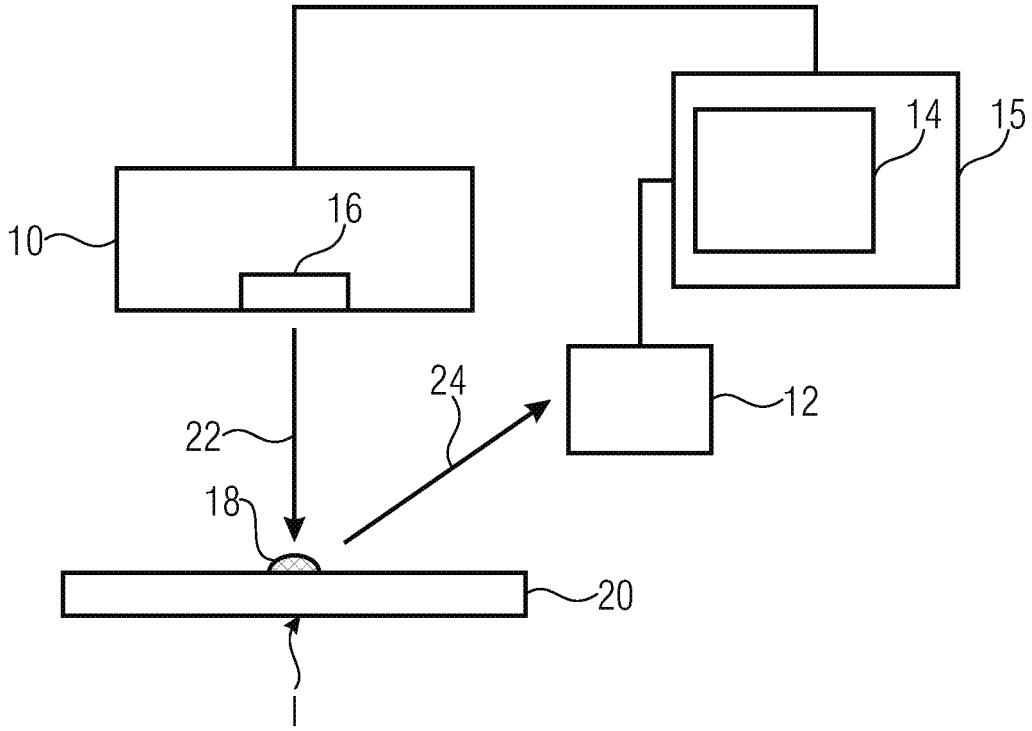
FIG. 1 is a block diagram of a system according to an example.

FIG. 1 shows a system according to an example of the present disclosure. The system comprises a printhead 10, a temperature sensor 12 and a processor 14. The printhead 10 comprises a nozzle 16. Nozzle 16 is to eject a drop of printing fluid to a location l of a print surface 20. This is indicated by an arrow 22 in FIG. 1 and results in a drop 18 on the print surface if the nozzle operates properly. In examples, the printing fluid is ink, such as pigment based, dye based or latex based ink. Temperature sensor 12 is to detect the temperature of location l of print surface 20 upon firing nozzle 16 to eject drop 18 of printing fluid to location l of print surface 20. Detecting the temperature is indicated in FIG. 1 by an arrow 24. Processor 14 determines whether nozzle 16 ejected drop 18 properly using the detected temperature.

In examples, processor 14 compares the detected temperature to a predetermined temperature and determines that nozzle 16 did not eject drop 18 properly if the detected temperature deviates from the predetermined temperature by more than a specific amount. In examples, the drop hitting location l of the print surface 20 locally decreases or increases the temperature of the printing surface and this local decrease or increase may be detected by temperature sensor 12. Processor may interpret this local decrease or increase in temperature as an indication that a drop was ejected properly. The locally decreased or increased temperature may be regarded as an expected or predetermined temperature and if a deviation of the temperature from the expected temperature is too large the processor determines that the nozzle did not eject the drop properly.

In examples, the system may be a printer and processor 14 may be part of an electronic printer controller 15. Printer controller 15 and processor 14 may be communicatively coupled to printhead 10 and temperature sensor 12. Electronic printer controller 15 may include a processor, machine readable instructions, memory components including volatile and non-volatile memory components, and other printer electronics for communicating with and controlling a printhead assembly including printhead 10 as well as other components, such as a printhead carriage, a media transport assembly and a service station. The components of the system may communicate information via any appropriate information transfer path, such as wired, wireless, infrared or optical. The printer controller 15 including processor 14 may control printhead 10 for ejection of an inkjet drop from nozzle 16. The printer controller may further control temperature sensor 12 to detect the temperature of location l immediately upon ejecting the drop to the location l, i.e., detection of the temperature is timely coordinated with the ejection of the drop.

Figure 2:
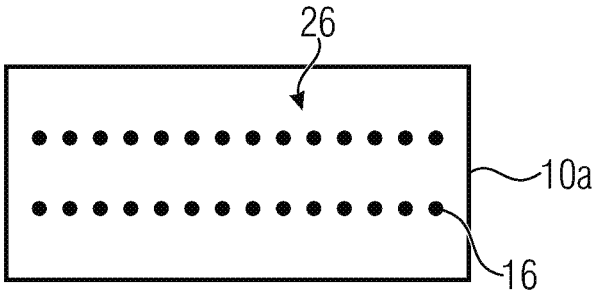
FIG. 2 is a schematic bottom view of a printhead comprising a nozzle array.

In examples, the printhead comprises a nozzle array including a plurality of nozzles. FIG. 2 schematically shows a bottom view of a printhead 10*a* comprising a nozzle array 26, which includes two rows and fourteen columns of nozzles 16. In such examples, the temperature sensor may detect the temperature of a plurality of locations of the print surface upon firing each of the plurality of nozzles to eject a drop of printing fluid to a different one of the locations of the print surface, and the processor may determine whether each nozzle ejected the drop properly using the detected temperatures. Thus, examples permit detection of faulty nozzles within an array of nozzles.

Generally, each nozzle may have associated therewith an ejection element, not shown, capable of operating to eject fluid drops through the associated nozzle, such as a thermal resistor or a piezoelectric actuator. Printer controller 15 controls ejection of fluid drops from the nozzles and controls the temperature sensor to detect the temperatures of target locations of print surface, i.e. locations at which the ejections are targeted, timely coordinated with the ejection of the fluid drops.

In examples, the temperature sensor may comprise an image acquisition device such as a camera, for example, an infrared camera. The infrared camera may be to detect temperatures of a plurality of locations on the print surface. In examples, the infrared camera comprises an array of infrared sensors. In examples, the infrared camera may be to perform a scan over the print surface to detect the temperatures of a plurality of locations of the print surface. In examples, the infrared camera is to capture a thermal image of an interesting portion of the print surface, i.e. the portion of the print surface, which is spitted by the nozzles. In examples, the temperature sensor is to detect the temperature at least at each location of the print surface which a nozzle of an array of nozzles is expected to eject a fluid drop to.

In examples, the infrared camera may be calibrated by capturing a thermal image of the print surface without ejecting drops of printing fluid onto the print surface. Thus, a non-uniformity map of the infrared camera may be generated and this non-uniformity map may be used to improve the thermal images captured later on. In examples, non-uniformities between pixels of the infrared camera may be balanced to enhance temperature differences caused by ejected printing fluid drops.

Figure 3:
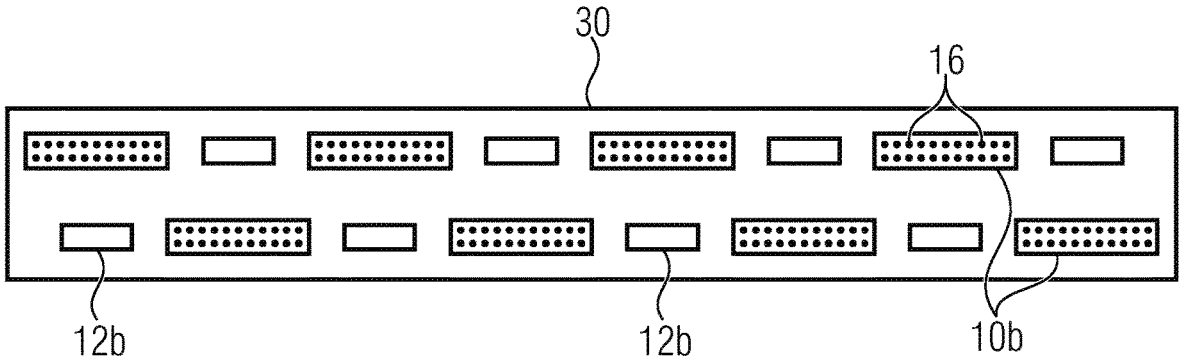
FIG. 3 is a schematic view of an example of a printhead assembly comprising a plurality of printheads.

In examples, the printhead may be attached to a carriage and may be moved along with the carriage in a direction perpendicular to a media advance direction. In other examples, the printhead may be part of a page wide printhead assembly. FIG. 3 schematically shows a bottom view of a printhead assembly 30 comprising a plurality of printheads 10*b*, wherein each printhead comprises an array of nozzles 16. In examples, printhead assembly 30 may be a page wide printhead assembly to achieve page wide printing. In examples, temperature sensors 12*b* may be attached to the printhead assembly 30 and may be to detect temperatures of the locations on a print surface, onto which nozzles 16 eject drops. Temperature sensors 12*b* may be formed by infrared cameras oriented toward the print surface to capture a thermal image of the print surface. In examples, the temperature sensor or temperature sensors may not be attached to the printhead assembly but may be attached to another part of a printer in which the printhead assembly is arranged.

Figure 4:
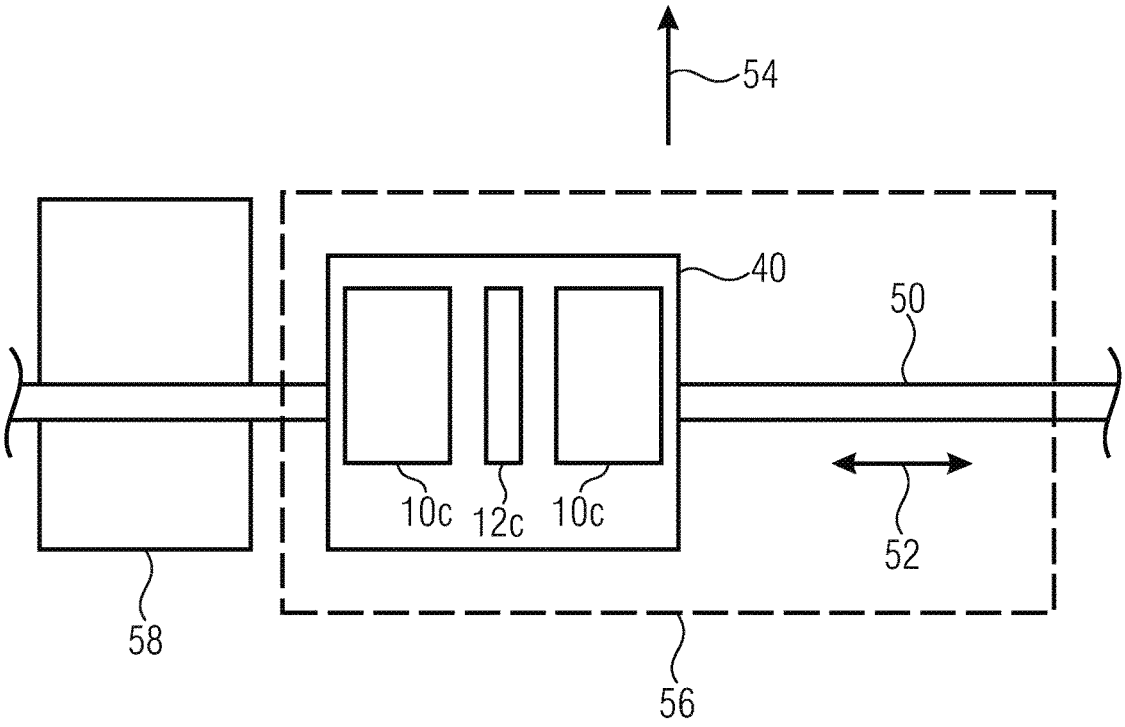
FIG. 4 is a schematic view of an example of a system comprising a servicing station.

In examples of the present disclosure, the system comprises a carriage carrying the printhead, wherein the temperature sensor is attached to the carriage. FIG. 4 schematically shows a system comprising a carriage 40. In the example shown carriage 40 carries two printheads 10*c*. In addition, a temperature sensor 12*c* is attached to carriage 40. Temperature sensor 12*c* is to detect temperatures of locations of a print surface, onto which nozzles, not shown in FIG. 4, of printheads 10*c* eject drops of printing fluid.

Carriage 40 is movable by a carriage transport system which is shown in FIG. 4 schematically as a guiderail 50. Carriage 40 is movable in two directions along guiderail 50 as indicated by an arrow 52 in FIG. 4. Thus, printheads 10*c* may move in directions perpendicular to a media advance direction 54. Thus, printheads 10*c* may be moved across a print area 56. Within print area 56, properly sequenced ejection of ink from the printhead nozzles may cause characters, symbols and/or other graphics or images to be printed upon print media, such as paper. This is generally known as executing a print job. Between swaths of printing the print media may be moved in the media advance direction by a media transport assembly. The system further comprises a servicing station 58. Servicing station 58 is arranged outside of print area 56. Accordingly, carriage 40 may be moved between print area 56 and servicing station 58. Servicing station 58 is to service the printhead. In examples, the print surface is a print surface of servicing station 58, such as plastic roller or a web wipe material. Servicing of the printhead in servicing station 58 may comprise firing the nozzles prior to conducting a print job within print area 56. The temperature sensor 12*c* may detect the temperature of location of the print surface of the servicing station upon firing the nozzles during servicing thereof in order to determine whether the nozzles operate properly or not.

Thus, in examples, the detection may be done utilizing firing of nozzles already performed for printhead servicing, where all nozzles may be fired previous to printing a job and in the beginning of every printed swath. Thus, examples permit a free detection method in terms of ink waste resulting in a high ink efficiency. In examples, drops are ejected onto a textile material or onto a flat surface of a spittoon of the servicing station 58.

As explained above, processor 14 may be part of a printer controller 15. Printer controller 15 controls firing of the plurality of nozzles of a nozzle array. The controller may disable a nozzle of the array of nozzles upon determining that this nozzle did not eject a drop of printing fluid properly. In examples, the controller may use a nozzle adjacent to the disabled nozzle when executing a print job later on.

As described above referring to FIG. 4, in examples, the print surface is part of a servicing station. In other examples, the print surface is a print medium, wherein the temperature sensor is to determine the temperature of a location of the print medium upon firing the nozzle to eject a drop of printing fluid to the location of the print medium during execution of a print job, i.e. during printing to generate a printed image on the print medium. Thus, in examples, faulty nozzles may be detected even on the fly during the execution of a print job. Thus, even nozzles failing during the execution of a print job may be replaced by functioning nozzles.

Accordingly, the present disclosure proposes to measure the temperature of a print surface and, therefore, the ink temperature on the print surface, just after spitting the nozzles as a feedback to check printhead nozzle status while printing or while servicing. Such a measurement may be implemented using a low-cost IR sensor. The indirect method to diagnose the health of nozzles enables to save ink spitted and time dedicated for printhead health diagnostics. In addition, from a constructive point of view, it enables to reduce printer space used to allocate current diagnostic systems, such as optical drop detector circuitry comprising light emitters and light detectors. In examples, the temperature sensor may be implemented on the printhead assembly, such as a printhead carriage, without allocating extra space in scan axis direction for such drop detector circuitry.

Examples of the present disclosure may use an array of thermal sensors, such as an array of infrared, IR, pixels, which is attached to the printer carriage with the purpose of sensing a thermal footprint of drops ejected by printhead nozzles. While the thermal sensor array may be placed on the carriage in examples of the present disclosure, in other examples, the temperature sensor may be fixed to another part of the printer. Assuming that any plot to print is formed by matrix of dots, that each dot is assigned to a nozzle, and each nozzle ejects a minimum quantity of ink over the print surface, such as the media surface, or any other material surface, such as a plastic roller or a web wipe material, it is possible to interpret the thermal footprint of the resulting drops ejected as an evidence that a printhead nozzle is in correct operational condition.

To this end, temperature detection is performed in a timely coordinated manner with the firing of nozzles. Temperature may be monitored immediately after firing each nozzle so that examples permit an immediate feedback on the functioning of the nozzle. This may be done during servicing, in which all nozzles may be fired. In other examples this may be done during regular printing to form an image on a print medium, wherein, of course, temperature detection is performed for such nozzles which are actually fired during regular printing, i.e., printing to form characters, symbols, and/or other graphics or images on a print medium.

Figure 5A:
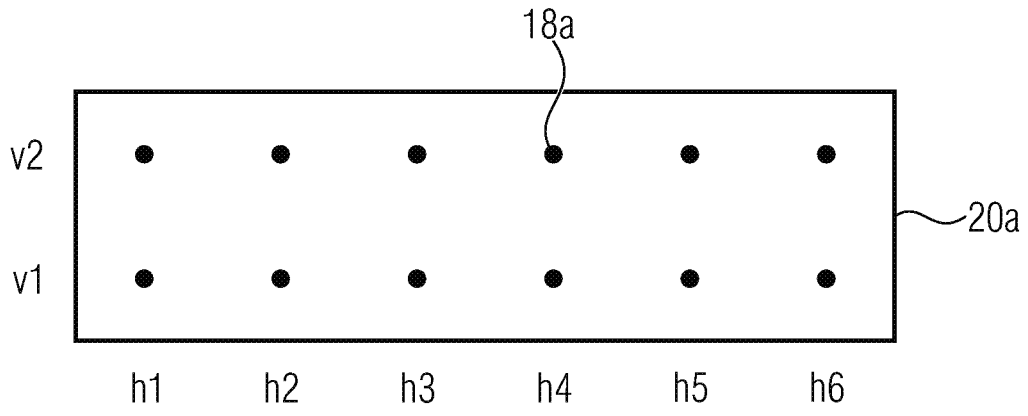
FIGS. 5A and 5*b* are representations of drops printed onto a print surface.

FIG. 5A shows a print image of twelve drops 18*a* of print fluid, which were printed on a print surface 20*a*. The drops are arranged in two rows and six columns, so that each drop is arranged at a vertical position v1 or v2 and at one of horizontal positions h1 to h6. Drops 18*a* shown in FIG. 5A may have been generated using an array of twelve nozzles, wherein each of the nozzles is to eject a drop to a different one of the locations. According to FIG. 5A, each nozzle was functioning properly so that a drop 18*a* is formed at each location. The drops may be formed concurrently or at different times.

Figure 5B:
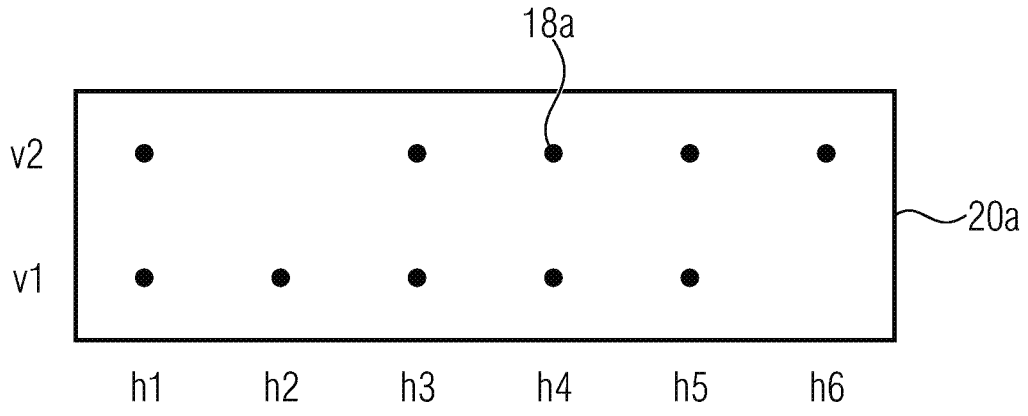

FIG. 5B shows a print image of drops 18*a* on print surface 20*a*, wherein two nozzles did not eject drops properly. To be more specific, the nozzle intended to eject a drop to the position v2, h2 and the nozzle intended to eject a drop to the position v1, h6 did not work properly. Thus, drops are not formed at these positions.

Figure 6A:
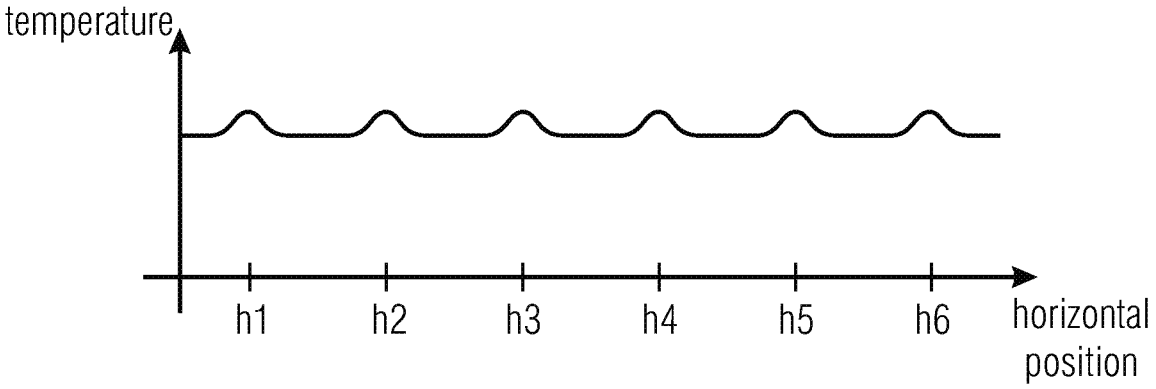
FIGS. 6A to 6C are diagrams showing temperatures of a print surface upon ejecting drops onto the print surface.
Figure 6B:
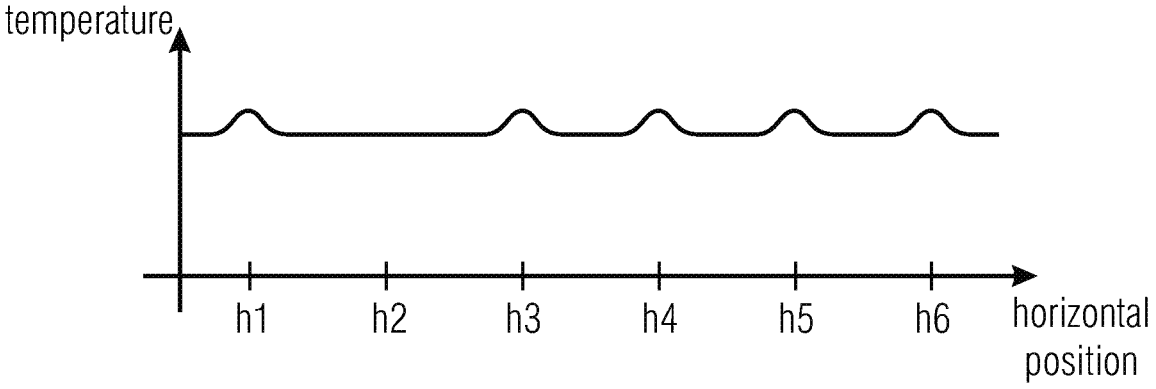
Figure 6C:
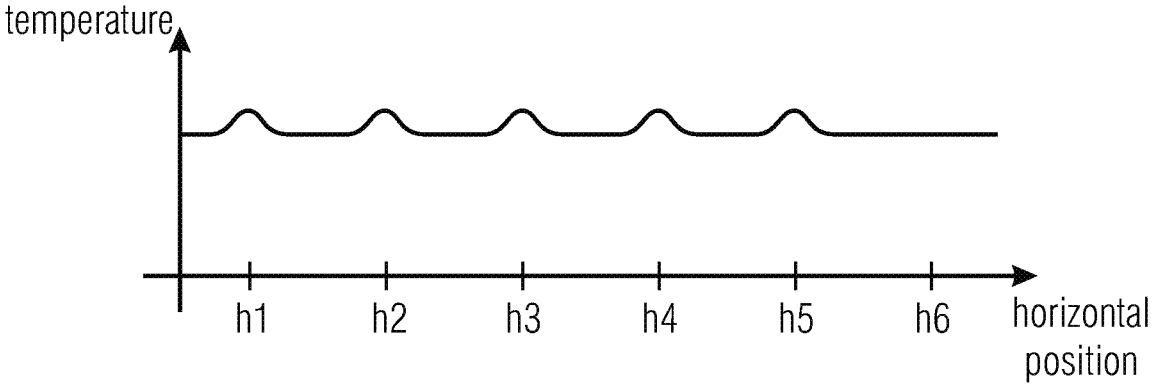

FIGS. 6A to 6C show temperature profiles or footprints of respective rows of drops shown in FIGS. 5A and 5B. FIG. 6A shows the temperature profile of a complete row of drops where a drop 18*a* is formed at each horizontal location h1 to h6. FIG. 6B shows a temperature profile, wherein a drop at horizontal position h2 is missing. FIG. 6C shows a temperature profile, in which a drop at horizontal position h6 is missing. Thus, the temperature profile in FIG. 6B corresponds to the upper row of drops in FIG. 5B and the temperature profile in FIG. 6C corresponds to the lower row of drops in FIG. 5B.

As shown in FIG. 6A to 6C, a drop at the respective position results in an increase of temperature at the specific location. Thus, by detecting the temperature immediately upon ejecting the drop to the corresponding position, it may be detected whether the drop was ejected properly or not. Thus, nozzles not working properly may be determined using the temperature profile of the print surface, which the drops are ejected to. Thus, according to the present disclosure, the temperature of the ink is not detected within the nozzle or at the nozzle but is detected upon ejecting the drop of ink to the print surface and upon the drop's landing on the print surface. In other examples a drop at the respective position results in a decrease of temperature at the specific location. In either case, a properly ejected drop of printing fluid results in a different temperature behavior when compared to a case in which the ejected droplet is not ejected properly and this different temperature behavior may be detected to determine whether a drop of printing fluid was ejected properly.

In examples the processor is to determine whether the temperature behavior at the location of the print surface is within a predetermined range and to determine that the nozzle did not eject the drop properly if the temperature behavior is not within the predetermined range. To this end, in examples, the processor may be perform at least one of: determining whether to temperature of the location of the print surface is within an expected temperature range; determining whether a temperature gradient between the temperature of the location of the print surface and an adjacent location of the print surface is within an expected temperature gradient range; and determining whether a temperature gradient between the temperature of the location of the print surface at a time after firing the nozzle and a temperature of the location of the print surface at a time before firing the nozzle is within an expected temperature gradient range.

In examples, the predetermined temperature behavior range is a range in which the temperature behavior is expected to be in if the drop of printing fluid was ejected properly.

In examples, the temperature behavior is the temperature at the location itself and the processor is to determine that the drop of printing fluid was not ejected properly if the detected temperature does not exceed an upper or a lower threshold.

In examples the temperature behavior is a temperature gradient or temperature difference between the temperature at the location and a temperature of an adjacent location of the print surface or the average temperature of a plurality of adjacent locations of the print surface. In such examples, the temperature sensor or another temperature sensor may be to also detect the temperature of the adjacent location or the adjacent locations and the processor may be to obtain the temperature gradient and to determine that the drop of printing fluid was not ejected properly if the temperature gradient does not exceed a threshold.

In examples, the temperature gradient may be a temperature gradient in time between a temperature of the specific location detected at a time before the associated nozzle was fired and a temperature of the specific location detected at a time after the associated nozzle was fired.

In examples, the print surface may be heated to a specific temperature, such as in a region of 25° to 35°. Upon ejecting a drop of print fluid to a specific location on the print surface, the specific location is cooled by a specific amount and this cooling may be detected. If the temperature of the print surface at the location concerned is not cooler than the surrounding print surface temperature by more than a specific amount, i.e. a threshold, it is determined that the nozzle did not eject the drop properly. In other examples, if the temperature of the print surface is lower than that of the ejected drops, a temperature increase by ejected drops may be evaluated in an analogous manner.

Generally, a temperature gradient may appear at the location to which a drop is properly ejected, i.e. the location at which a drop is properly ejected and an adjacent location of the print surface. This temperature gradient may be detected to determine whether a drop was ejected properly. Thus, in examples, the temperature sensor may detect a temperature gradient between the temperature of the location of the print surface and an adjacent location of the print surface, and the processor may compare the detected temperature gradient to a predetermined temperature gradient and may determine that the nozzle did not eject the drop properly if the detected temperature gradient deviates from the predetermined temperature gradient by more than a specific amount.

In examples, a commercial thermal camera may be used to detect the temperatures at the interesting locations. In other examples, other temperature sensors may be used. For example, temperature sensors may be integrated into the print surface so that the temperature of the interesting locations of the print surface may be detected directly.

The information from the temperature sensor or temperature sensors may be processed directly at the carriage side, i.e., within the printhead assembly. In other examples, the information may be processed in a printer controller external to the printhead assembly. The controller, in which the processor is implemented, may be to control the components described herein to provide the functionality described herein and to execute methods described herein. The controller may be implemented, for example, by discrete modules or data processing components, that are not limited to any particular hardware and machine-readable instruction configuration. The controller may be implemented in any computing or data processing environment, including in digital electronic circuitry, e.g., an application-specific integrated circuit, such as a digital signal processor, DSP, or in computer hardware, device driver, or machine-readable instructions. In some implementations, the functionalities are combined into a single data processing component. In other implementations, the respective functionalities may be performed by a respective set of multiple data processing components. The printer controller may comprise a processor, which may be the processor described above or an additional processor, and a memory device accessible by the processor. The memory device may store process instructions, machine-readable instructions, such as computer software or firmware, for implementing methods executed by the controller. The memory device may store instructions to control components of the system, such as the printing apparatus, to perform the processes described herein. The memory device may include tangible machine-readable storage media. Memory devices suitable for embodying these instructions and data include all forms of computer-readable memory, including, for example, semiconductor memory devices, such as EPROM, EEPROM, and flash memory devices, magnetic disks such as internal hard disks and removable hard disks, magneto-optical disks, and ROM/RAM devices. Routines and processes to perform the methods described herein may be stored in such a memory device.

The printer controller may be to use the output of the determination whether a nozzle is working properly or not in other processes, such as nozzle replacement. A nozzle determined not to eject drops properly may be disabled in such processes to avoid image quality defects. Such processes may use neighbor nozzles instead of the faulty one.

Generally, the temperature sensor or temperature sensors are arranged to detect the temperature of a print fluid drop or a specific location of a print surface after the print fluid drop was ejected to the print surface and has landed on the specific location. In examples, the temperature sensor is to detect the temperature of a plurality of locations concurrently so that temperatures of print fluid drops stemming from an array of nozzles may be detected concurrently. In either case, detection of the temperature takes place synchronized with the ejection of drops from the respective nozzles.

Figure 7:
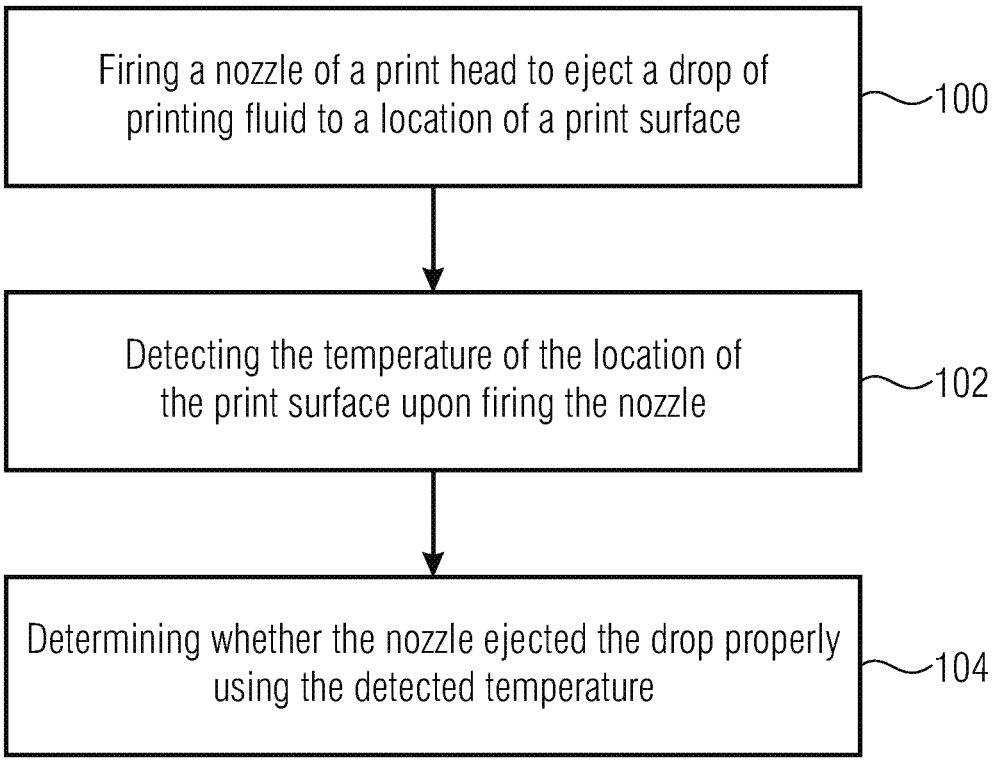
FIG. 7 is a flow diagram of an example of a method to determine whether a nozzle ejected a drop of printing fluid properly.

FIG. 7 shows an example of a method of determining whether a nozzle ejected a drop of printing fluid properly. At 100, a nozzle of a printhead is fired to eject a drop of printed fluid to a location of print surface. At 102, the temperature of the location of the print surface upon firing the nozzle is detected. At 104, it is determined whether the nozzle ejected the drop properly using the detected temperature.

In examples, determining whether the nozzle ejected the drop properly comprises comparing the detected temperature to a predetermined temperature and determining whether the nozzle deviates from the predetermined temperature by more than a predetermined amount. The predetermined temperature may be the temperature expected if the drop of printing fluid is ejected properly. If the deviation of the detected temperature from the predetermined temperature exceeds the predetermined amount, it is determined that the nozzle did not eject the drop properly. If the deviation of the detected temperature from the predetermined temperature does not exceed the predetermined amount, it is determined that the nozzle did eject the drop properly.

In examples, if a difference between the detected temperature and the predetermined temperature is higher than a threshold, it is determined that the drop was ejected properly. In examples, the predetermined temperature is the temperature of media onto which the drop is ejected. Thus, in examples, detection can be implemented by detecting the temperature difference between a target point where the drop of printing fluid should be dropped and the surrounding media temperature. In examples, the media temperature may be set constant, such as if the media temperature is stable. In examples, the media temperature may be measured from time to time and the threshold may be adapted accordingly, such as if the media temperature is subject to changes.

In examples, firing, detecting and determining is conducted for a plurality of nozzles, concurrently or at different times, wherein the method further comprises disabling any nozzle determined not to eject the drop of printing fluid properly. In examples, firing and detecting takes place during servicing the printhead in a servicing station. In examples, firing and the detecting takes place during execution of a print job to generate a printed image on a print medium.

Examples of the present disclosure are effective to provide a performance enhancement with respect to ink consumption, time consumption and size savings. In addition, examples may provide additional feedback that enables further image quality fine tuning. In examples, monitoring in runtime the drop thermal trace may provide the possibility to extract additional valuable information with regard to drop size, drop consistency, drop positioning, drop trajectory, pen to paper positioning, spray, satellites and other print quality defects caused by dot characteristics, such as poor density, poor placement, weak dots, paper feed errors and drop velocity variations. For example, thermal images from the print surface may be used to derive information on drop size and drop position and such information may be used to correct drop size and drop position in executing following print jobs. Thus, examples permit further information to be derived in addition to the determination whether a drop has properly been ejected or not.

As indicated above, the present disclosure allows a printer to carry out a run-time or while-printing processing. This means that the nozzles' health may be continuously checked and, therefore, the system may always have good performance in terms of quality since it enables while-printing nozzle replacement. This may result in time savings. The present disclosure has the effect of enabling detection of nozzle health status in real printing conditions, i.e., under representative pen to paper spacing and firing frequency within the normal operation range. Thus, the firing frequency is not to be increased beyond stable operation conditions as in previous solutions in which such firing frequencies were used to get a good blockage of a light beam. In addition, the present disclosure provides a robust method to assess nozzle health independently of the color of the print fluid.

In addition, the present disclosure permits a cost effective solution. The costs of commercial infrared sensors may be lower than the costs of drop detectors using light sources and light detectors. In addition, since run-time methods may be used to check nozzle quality performance, media waste due to image quality defects may be avoided. In addition, the present disclosure may be effective to achieve a reduction in wasted ink since nozzle health may be detected during printing or since the footprint of the drops fired during a servicing event that happens during or before the execution of a job and is present anyway may be analyzed.

Examples of the present disclosure are not linked to a specific type of printhead and may be used in any type of printhead and the solution may be scaled up or down very easily. This is not possible with respect to current drop detectors, which have a specific size in a particular dimension, such as the distance between a light source and a light detector, and may not be used if the printhead has a different size in this dimension.

Examples of the present disclosure use a thermal sensor oriented towards the print surface, i.e., the media surface or any other part, such as a web wipe roll, that may be ink sprinkled.

Accordingly, examples of the present disclosure may be effective to reduced plot errors and customer dissatisfaction due to defective plots, media waste and extra expenses. Examples permit a detection of faulty nozzles with reduced expenses in terms of time and/or costs when compared to common approaches, which use a light barrier with the purpose of detecting if all nozzles are spitting ink in the optimal conditions. So far, this check may be featured in two ways: sequentially, printhead by printhead, to reduce the number of barriers and the costs involved, but with higher total time for the diagnosis, or all printheads at the same time, which reduces the total time to check but causes higher costs and increases the total width of the printer since a number of parallel light barriers have to be accommodated.

Examples relate to a non-transitory machine-readable storage medium encoded with instructions executable by a processing resource of a computing device to perform methods described herein.

Examples described herein may be realized in the form of hardware, machine-readable instructions or a combination of hardware and machine-readable instructions. Any such machine-readable instructions may be stored in the form of volatile or non-volatile storage such as, for example, a storage device, such as a ROM, whether erasable or rewritable or not, or in the form of memory such as, for example, RAM, memory chips, device or integrated circuits or an optically or a magnetically readable medium, such as, for example, a CD, DVD, magnetic disk or a magnetic tape. The storage devices and storage media are examples of machine-readable storage, that are suitable for storing a program or programs that, when executed, implement examples described herein.

All the features disclosed in the specification, including any accompanying claims, abstract and drawings, and/or all the features of any method or progress described may be combined in any combination, including and claim combination, except combinations where at least some of such features are mutually exclusive. In addition, features disclosed in connection with a system may, at the same time, present features of a corresponding method, and vice versa.

Each feature disclosed in the specification, including any accompanying claims, abstract and drawings, may be replaced by alternative features servicing the same, equivalent or a similar purpose, unless expressly stated otherwise. Thus, unless expressly stated otherwise, each feature disclosed is one example of a generic series of equivalent or similar features.

The foregoing has described the principles, examples and modes of operation. However, the teaching herein is not to be construed as being limited to the particular examples described. The above described examples are to be regarded as illustrative rather than restrictive, and it is appreciated that variations may be made in those examples by those skilled in the art without departing from the scope of the following claims.

The invention claimed is:

1. A system, comprising:

a print head comprising a nozzle;

a temperature sensor to detect, upon firing the nozzle to eject a drop of printing fluid to a location of a print surface, a temperature of the location of the print surface when the drop is expected to land at the location, wherein the print surface is a print medium, and wherein the temperature sensor is to determine the temperature of the location of the print medium upon firing the nozzle to eject a drop of printing fluid to the location of the print medium during execution of a print job to generate a printed image on the print medium; and a processor to determine whether the nozzle ejected the drop properly using the detected temperature.

2. The system of claim 1, wherein the processor is to determine whether the nozzle ejected the drop properly using the detected temperature by determining whether the temperature behavior at the location of the print surface is within a predetermined range and determines that the nozzle did not eject the drop properly if the temperature behavior is not within the predetermined range.

3. The system of claim 2, wherein the processor is to determine whether the temperature behavior is within the predetermined range by at least one of:

determining whether a temperature of the location of the print surface is within an expected temperature range;

determining whether a temperature gradient between the temperature of the location of the print surface and an adjacent location of the print surface is within an expected temperature gradient range; and determining whether a temperature gradient between the temperature of the location of the print surface at a time after firing the nozzle and a temperature of the location of the print surface at a time before firing the nozzle is within an expected temperature gradient range.

4. The system of claim 1, wherein the print head further comprises a nozzle array including a plurality of nozzles, wherein the temperature sensor is to further detect the temperature of a plurality of locations of the print surface upon firing each of the plurality of nozzles to eject a drop of printing fluid to a different one of the locations of the print surface, and the processor is to further determine whether each nozzle ejected the drop properly using the detected temperatures.

5. The system of claim 4, comprising a controller to control firing of the plurality of nozzles, wherein the controller is to disable a nozzle of the array of nozzles upon determining that that nozzle did not eject the drop of printing fluid properly.

6. The system of claim 5, wherein the controller is to use a nozzle adjacent to the disabled nozzle when printing a print job.

7. A system, comprising:

a print head comprising a nozzle;

a temperature sensor to detect, upon firing the nozzle to eject a drop of printing fluid to a location of a print surface, a temperature of the location of the print surface when the drop is expected to land at the location, wherein the temperature sensor comprises an infrared camera; and a processor to determine whether the nozzle ejected the drop properly using the detected temperature.

8. The system of claim 7, comprising a servicing station to service the print head, wherein the print surface is a print surface of the servicing station, wherein servicing the printhead comprises firing the nozzle prior to conducting a print job, and wherein the temperature sensor is to detect the temperature of a location of the print surface of the servicing station upon firing the nozzle during servicing thereof.

9. A system, comprising:

a print head comprising a nozzle;

a temperature sensor to detect, upon firing the nozzle to eject a drop of printing fluid to a location of a print surface, the temperature of the location of the print surface when the drop is expected to land at the location; and a carriage carrying the print head, wherein the temperature sensor is attached to the carriage.

10. A method of determining whether a nozzle ejected a drop of printing fluid properly, comprising:

firing a nozzle of a print head to eject a drop of printing fluid to a location of a print surface, wherein the firing and the detecting takes place during execution of a print job to generate a printed image on a print medium;

detecting the temperature of the location of the print surface when the drop is expected to land at the location upon firing the nozzle;

determining whether the nozzle ejected the drop properly using the detected temperature.

11. The method of claim 10, comprising determining whether the temperature behavior at the location of the print surface is within a predetermined range and to determine that the nozzle did not eject the drop properly if the temperature behavior is not within the predetermined range by at least one of:

determining whether to temperature of the location of the print surface is within an expected temperature range;

determining whether a temperature gradient between the temperature of the location of the print surface and an adjacent location of the print surface is within an expected temperature gradient range; and determining whether a temperature gradient between the temperature of the location of the print surface at a time after firing the nozzle and a temperature of the location of the print surface at a time before firing the nozzle is within an expected temperature gradient ranges.

12. The method of claim 10, wherein the firing, the detecting and the determining is conducted for a plurality of nozzles, the method comprising disabling any nozzle determined not to eject the drop of printing fluid properly.

* * * * *